United States Patent [19]

Pfau

[11] Patent Number: 4,960,054

[45] Date of Patent: Oct. 2, 1990

[54] OFFSET PRINTING BY REPEATEDLY INKING BLANKET BEFORE CONTACT WITH STOCK MATERIAL

[75] Inventor: Paul Pfau, Mühlheim/Ruhr, Fed. Rep. of Germany

[73] Assignee: Paul Pfau GmbH & Co. KG

[21] Appl. No.: 386,908

[22] Filed: Jul. 27, 1989

[30] Foreign Application Priority Data

Jul. 27, 1988 [DE] Fed. Rep. of Germany ..... 3825480

[51] Int. Cl.[5] ..... B41M 1/06; B41M 1/18

[52] U.S. Cl. ..... 101/451; 101/211; 101/492

[58] Field of Search ..... 101/450.1, 451, 452, 101/211, 152, 492

[56] References Cited

U.S. PATENT DOCUMENTS

| | | | |
|---|---|---|---|
| 4,241,657 | 12/1980 | Fujimori | 101/211 |
| 4,452,139 | 6/1984 | Dahlgren et al. | 101/450.1 X |
| 4,766,809 | 8/1988 | Giori et al. | 101/152 |

*Primary Examiner*—Clifford D. Crowder

*Attorney, Agent, or Firm*—Toren, McGeady & Associates

[57] ABSTRACT

A process for the offset printing of stock material in which the blanket is inked repeatedly with the printing ink so that an image having an elevated ink layer thickness is produced on the blanket. Before the transfer of the image to the stock any moisture (water) on the blanket is removed, whereafter a non-hygroscopic stock is printed in a single printing step. Consequently, a high color saturation after a single printing is produced even when transparent or opal foil is used for illuminated advertising.

8 Claims, No Drawings

OFFSET PRINTING BY REPEATEDLY INKING BLANKET BEFORE CONTACT WITH STOCK MATERIAL

DESCRIPTION

The invention relates to a process for the offset printing of stock material in which a printing forme is damped and inked with a printing ink, whereafter the image is transferred from the inked forme onto a blanket and therefrom onto the stock material.

Offset printing is of course a planographic process in which the printing and non-printing areas of the forme are substantially coplanar with one another. The forme is so prepared that the areas not to be inked accept water and do not absorb ink whereas the areas to be inked accept ink and do not absorb water. The plate areas not to be printed are damped by means of a damping unit and the ink is applied to the areas to be printed by means of an inking unit. The image of the inked forme, which can be an printing plate or printing cylinder is first transferred to a blanket cylinder. The blanket cylinder then prints on the stock, which is usually a paper or plastics foil sheet required to be printed. In multicolour printing a number of offset printing units are disposed serially or as an array of consecutive units so that each printing unit deals with the printing of one printing ink. As a rule, the stock is printed with each ink only once. However, this single printing is inadequate when a very high colour saturation or a colour-intensive end product is required. This applies more particularly to transparencies and transparent plastics foils used in illuminated displays. Such foils remain pale for, unlike paper, the colouring provided by an application of a given layer thickness of ink is appreciably less than in the case of paper. One apparent possibility would be to print plastics foils—and basically other stocks—a number of times—i.e., to offset-print a number of times. However, multiple printing of this kind has a number of disadvantages. For example, mackling occurs in which the halftone dots of ink of the same colour become displaced from one another, the reason being that the stock distorts because of tensile stressing in the various printing operations. This in turn leads to displacements of tones or colour and, therefore, to an unsatisfactory gradation. The multicolour printed end product is therefore blurred and lacks the required colour saturation if for no other reason than because of the ink displacements.

A process for increasing colour saturation is known in which the blanket is printed twice by the forme and only then does the twice-printed blanket transfer the ink to the stock in a single printing step. However, the stock used in this case is paper, a material which readily accepts damper and ink. This known process cannot be used to print stocks, such as plastics or foils thereof, which do not absorb moisture and do not readily accept ink, for moisture or water as well as ink are always transferred to the blanket. Whereas the moisture which arises in the printing of paper is readily absorbed by this hygroscopic stock, when stocks such as plastics or foils thereof which do not absorb moisture are being printed the moisture remains on the blanket. Consequently, so much moisture or water builds up on the blanket after a few printing operations that there is some expulsion of the ink and some emulsification of the ink with the water. The result is an irregular and weak-coloured print. Also, the ink emulsified with the water cannot dry, for a reason which has to do with the surface drying of the ink, which cannot yield moisture or water to the stock during the printing of moisture-impervious materials.

It is the object of the invention to provide a process of the kind hereinbefore set out in which moisture-repellent stock material, more particularly plastics foils or illuminated displays, can be offset-printed simply, rapidly and satisfactorily which high colour saturation.

The invention solves the problem in a process of this kind in that the blanket is inked repeatedly with a printing ink so that an image having an elevated ink layer thickness is produced on the blanket, whereafter the image is transferred in a single printing step from the blanket to the stock and before the transfer of the printing ink or image to the stock moisture or water present on the blanket is removed, whereafter a non-hygroscopic stock is printed. The term "blanket" denotes for the purposes of the invention any material which transfers printing ink from the printing forme to the stock and which is adapted for the oversaturated reception of printing ink. The normal blanket can be oversaturated—i.e., it can actually receive printing ink in the sense of repeated inking. For repeated inking of the blanket, the printing forme is repeatedly damped and inked and after each inking the blanket cylinder—the blanket is normally clamped on a cylinder—accepts the ink—i.e., ink image—from the inked forme until the required ink layer thickness has been built up. According to the invention, the moisture (water) transferred with the ink to the blanket is removed. Only then is the image transferred, with the corresponding elevated ink layer thickness, in correct register and accurately to the non-hygroscopic stock in a single printing step. Surprisingly, not only does the ink detach readily from the blanket in the required layer thickness but also the ink is accepted satisfactorily on the stock which not only does not absorb moisture but which also does not accept ink readily. Because of the, as it were, demoisturized or dewatered single printing mackling is avoided and there are no shifts of tone or colour. Indeed, the non-hygroscopic stock printed in accordance with the invention is distinguished by particular colour intensity and high colour saturation which can readily be monitored by proofs. In any case it can readily be checked by monitoring how often the blanket needs to be inked and demoisturized or dewatered—i.e., whether, for example, blanket needs inking and demoisturizing or dewatering twice or three or four times etc in the light of the ink used, the moisture and the required colour saturation. Once a standard has been set all the sheets can be printed continuously. The printed end product is always colour-intensive and sharp.

Other features of importance for the invention are set out hereinafter. According to the invention, for instance, the moisture or water is removed completely immediately after each transfer of ink from the forme to the blanket. According to a proposal having independent importance, the blanket is blown, for example, with hot air, to remove moisture or water. According to the invention, in multicolour printing the blanket used for each ink is inked repeatedly and has the moisture or water removed and the combined printing of the discrete inks is effected consecutively in each case by a single printing. According to the invention, transparent or opal foils are used as stock material for the preparation of illuminated displays or colour transparencies. In fact, according to the invention, due to the elevated inked layer thickness excellent colouring can be achieved even with transparent or opal foils or stock material made of transparent plastics such as hard PVC, so that the colour contrasts necessary for illuminated displays are ensured. The elevated ink layer thickness necessary for illuminated transparencies can be achieved only by a repeated transfer of ink to the blanket, more particularly when regard is had to contemporary high-pigment printing inks. This calls for removal of the moisture or water from the blanket in the printing of non-hygroscopic materials such as transparent or opal plastics foils. In fact, the application of ink is so substantial that the printed material can be viewed only when backlit. The process according to the invention is suitable for use with standard damping units as well as with alcohol damping units. A row of blowers which is associated with the blanket or blanket cylinder provides the necessary demoisturizing or dewatering. Radiant heat or similar heating facilities can be used provided that there is no risk of the printing ink drying out prematurely.

I claim:

1. In a process for the offset printing of stock material, the process including damping a printing forme and inking the printing forme with printing ink, subsequently transferring the image from the inked forme to a blanket and then from the blanket to the stock material, the improvement comprising inking the blanket repeatedly with the printing ink so as to produce an image having an elevated ink layer thickness on the blanket, subsequently transferring the image in a single printing step from the blanket to the stock material and, before the transfer of the printing ink or image to the stock material, removing moisture or water present on the blanket, and finally printing a non-hygroscopic stock material.

2. A process according to claim 1, characterised in that the damper or water is removed completely immediately after each transfer of ink from the forme to the blanket.

3. A process according to claim 1 or 2, comprising blowing the blanket to remove moisture or water.

4. A process according to claim 3, comprising blowing the blanket with hot air to remove moisture or water.

5. A process according to claims 1 or 2, comprising for multicolour printing repeatedly inking the blanket used for each ink and removing the moisture or water from the blanket and effecting the combined printing of the discrete inks consecutively in each case by a single printing.

6. A process according to claims 1 or 2, comprising using transparent or opal foils as stock material for the preparation of illuminated displays.

7. A process according to claims 1 or 2, comprising using transparent plastics material as stock material or transparent foils or opal foils.

8. A process according to claim 7, wherein the transparent plastics material is hard PVC.

* * * * *